United States Patent [19]

Sander

[11] 4,074,506

[45] Feb. 21, 1978

[54] PACKAGING APPARATUS

[75] Inventor: Bernd Sander, Halle, Germany

[73] Assignee: Cito Kunststoffe und Verpackungsfolien Erich Gilberg KG, Kunsebeck, Germany

[21] Appl. No.: 753,247

[22] Filed: Dec. 22, 1976

[51] Int. Cl.[2] ..... B65B 57/10; B65B 43/34

[52] U.S. Cl. ..... 53/59 R; 53/189; 53/372

[58] Field of Search ..... 53/74, 59 R, 189, 372; 198/856

[56] References Cited

U.S. PATENT DOCUMENTS

| | | | |
|---|---|---|---|
| 3,340,678 | 9/1967 | Rhodes | 53/372 |
| 3,427,781 | 2/1969 | Kral | 53/74 |
| 3,538,671 | 11/1970 | Wallace | 53/189 X |
| 3,552,088 | 1/1971 | Niwa | 53/74 X |
| 3,579,951 | 5/1971 | Lowery | 53/189 X |
| 3,831,737 | 8/1974 | Joyce | 198/856 X |
| 3,914,917 | 10/1975 | Young | 53/372 X |

*Primary Examiner*—Travis S. McGehee
*Attorney, Agent, or Firm*—Seidel, Gonda & Goldhammer

[57] ABSTRACT

Automatic packaging apparatus is disclosed for mechanically introducing an open top tray, containing goods, into a plastic bag. A means is provided to weld the open end of the bag, trim the edge of the bag, and then heat shrink the bag around the tray.

11 Claims, 9 Drawing Figures

PACKAGING APPARATUS

SUMMARY OF THE INVENTION

The automatic packaging apparatus of the present invention is adapted to receive open an top tray containing goods, place the tray in a bag, weld the open end of the bag, and then heat shrink the bag around the tray. A first conveyor delivers the open top trays to a pushing means. The pushing means includes a pusher for pushing the tray into a previously opened bag of polymeric plastic material capable of being welded. The bagged tray is then moved along a second conveyor.

A means is provided along the second conveyor for sealing a bagged tray by welding the open end of the bag. Also, a means is provided for trimming off the edge scrap of the bag adjacent to the weld. And a means is provided thereafter for shrinking the bag about the tray to provide a tight package.

It is an object of the present invention to provide an automatic packaging machine for packaging open top trays in a manner which is reliable and capable of high production rates.

Other objects will appear hereinafter.

For the purpose of illustrating the invention, there is shown in the drawings a form which is presently preferred; it being understood, however, that this invention is not limited to the precise arrangements and instrumentalities shown.

Referring to the drawing in detail, wherein like numerals indicate like elements, there is shown in FIG. 1 a top plan view of apparatus in accordance with the present invention and designated generally as 10.

Figure 4:
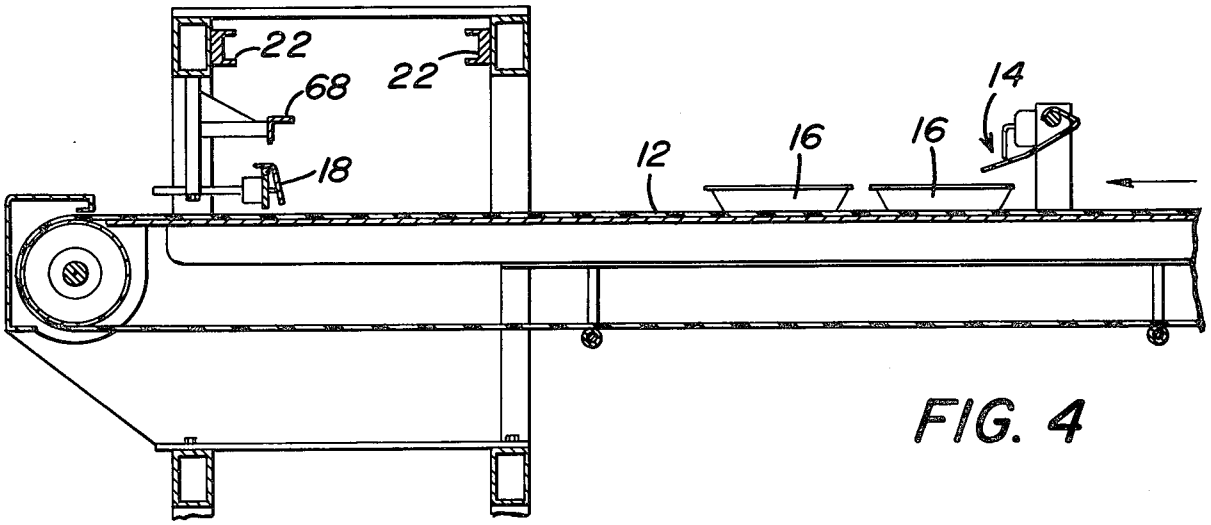
FIG. 4 is a sectional view taken along the line 4—4 in FIG. 3.

The apparatus 10 includes a frame supporting an infeed conveyor 12. Open top trays 16 are filled with goods and deposited onto the conveyor 12. A typical tray 16 is about 17 by 25 cm and has a height of about 3 cm. A height gauge 14 is associated with the conveyor 12. See FIG. 4. If the contents of the trays 16 projects upwardly beyond a predetermined height, the gauge 14 will be contacted thereby and will trip a microswitch which in turn will stop the conveyor 16.

Figure 1:
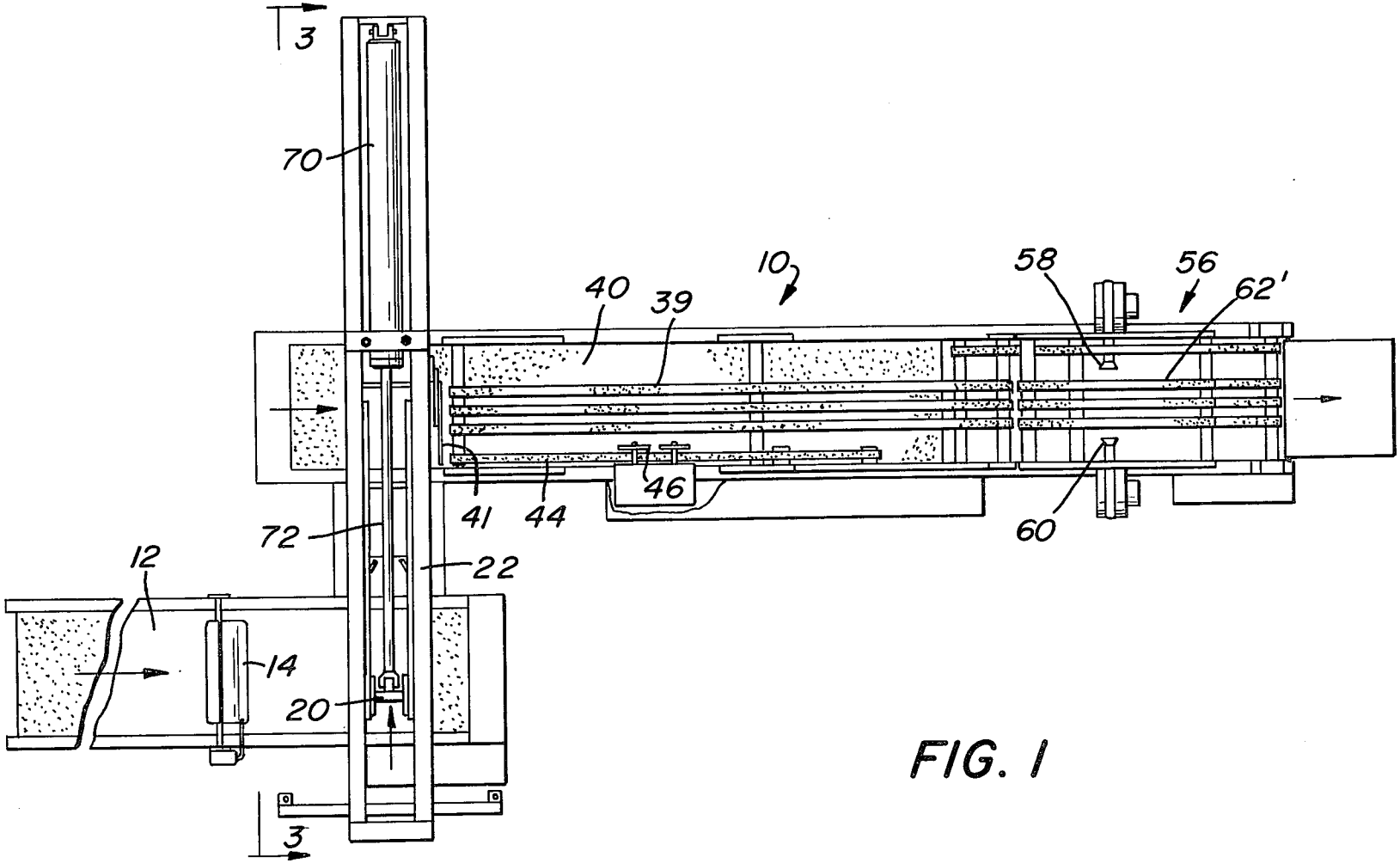
FIG. 1 is a top plan view of apparatus in accordance with the present invention.

The trays 16 may be made of a wide variety of materials including foam plastic, paperboard, etc. and preferably have side walls angled upwardly and outwardly. When the loaded tray 16 contacts the switch plate 18, the tray will be on first conveyor 12 directly in front of a pusher 24 on carriage 20. The carriage 20 is supported for reciprocation by a track 22. As shown more clearly in FIG. 1, the track 22 is perpendicular to the infeed conveyor 12.

Switch plate 18 initiates movement of the carriage 20 along the track 22 with the pusher 24 engaging a side face of the tray 16. The tray 16 is pushed toward a bag station wherein the uppermost bag 32 of a bag stack 34 will be open. As the tray 16 moves toward the bag 32, carriage 20 will trip a microswitch to thereby cause the gates 28 and 30 to pivot away from each other and into the open bag 32 so that the tray 16 may easily enter the bag 32. Gates 28, 30 have a height corresponding to said predetermined height. Each of the bags at the bag stack 34 are retained in position by pins 36 extending through punched holes in the lip of the bags 32. The uppermost bag 32 is opened by air discharging from nozzle 37.

The pusher 24 pushes the tray 16 into the bag 32 and continues to push the tray thereby stipping the bag 32 from the pins 36. The tray 16 and bag 32 are moved by the pusher 24 until they contact the limit stop 38 mounted above the outfeed conveyor 40. At this point, the carriage 20 trips a microswitch which causes the carriage to reverse its direction and return to its starting position. The bag 32 containing the tray 16 is immediately moved by the conveyor 40 against the squaring plate 41. Squaring plate 41 assures that the bag will not be angularly disposed but rather will be in a position so that the edges at the open end of the bag will be parallel to the conveyor 40. As soon as the bag 32 and tray 16 therewithin have been squared by the squaring plate 41, plate 41 is pivoted upwardly out of the way by a microswitch tripped by the carriage 20.

Figure 6:
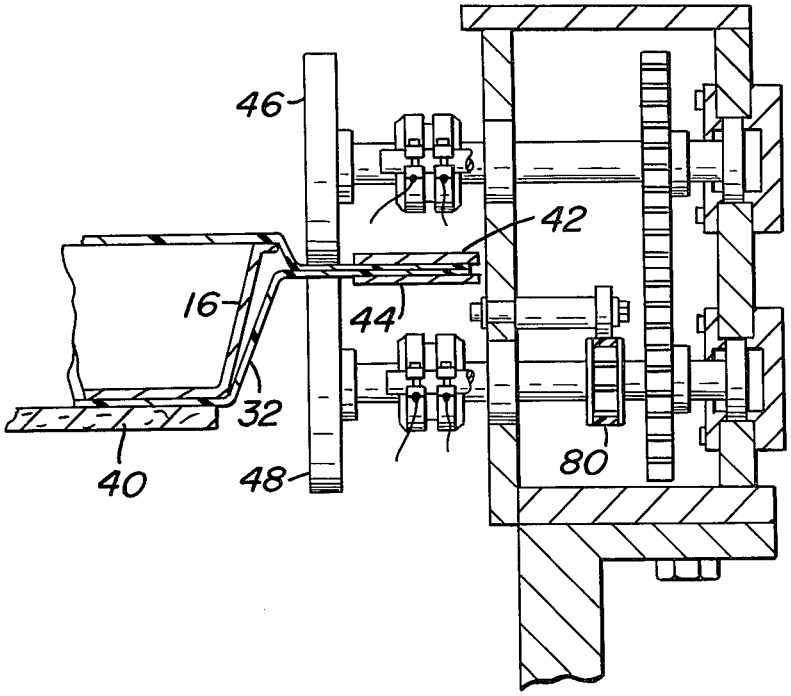
FIG. 6 is a sectional view taken along the line 6—6 in FIG. 5.
Figure 7:
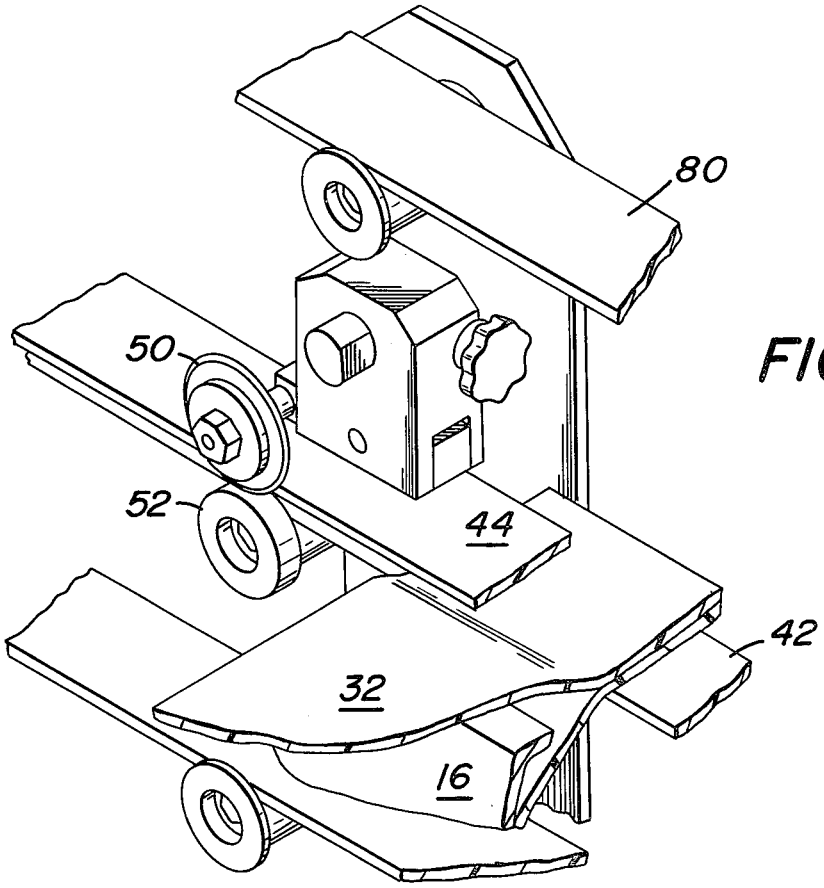
FIG. 7 is a perspective view on an enlarged scale illustrating the trimming station.

The bag 32 and tray 16 therewithin are held flat on the conveyor 40 by a plurality of overhead belts 39. Also, the open end of the bag 32 is held closed by passing between endless belts 42, 44. See FIGS. 2, 6 and 7.

A means is provided for welding the open end of the bag 32 adjacent one side edge of the tray 16. See FIG. 6. With the open end of the bag 32 clamped between, the belts 42, 44 which move at the same speed as conveyor 40, welding rollers 46 and 48 apply a weld to the bag 32 thereby closing the bag and sealing it adjacent to the tray 16.

Immediately thereafter, the sealed bag 32 containing the tray 16 is conveyed past a trim cutting wheel 50 and anvil 52. Wheel 50 trims off the edge of the bag. The scrap cut by wheel 50 remains between the belts 42 and 44.

Figure 2:
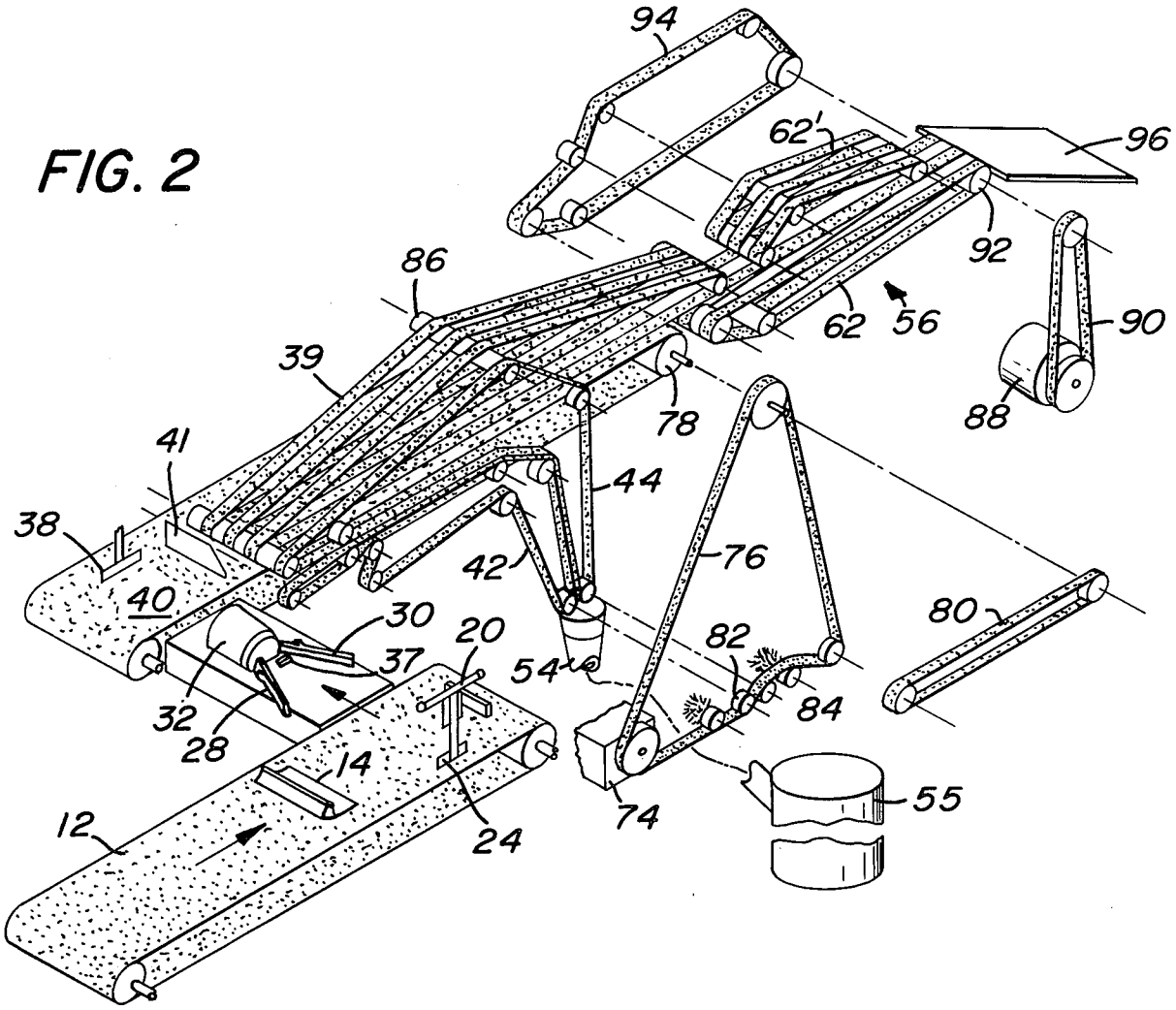
FIG. 2 is a diagrammatic perspective view of the conveyors and belts on the apparatus of the present invention.

As shown more clearly in FIG. 2, belts 42 and 44 extend downwardly from the elevation of conveyor 40 and then extend around rollers in opposite directions so as to discharge the scrap into a vacuum conduit 54 connected to a vacuum tank 55.

Figure 8:
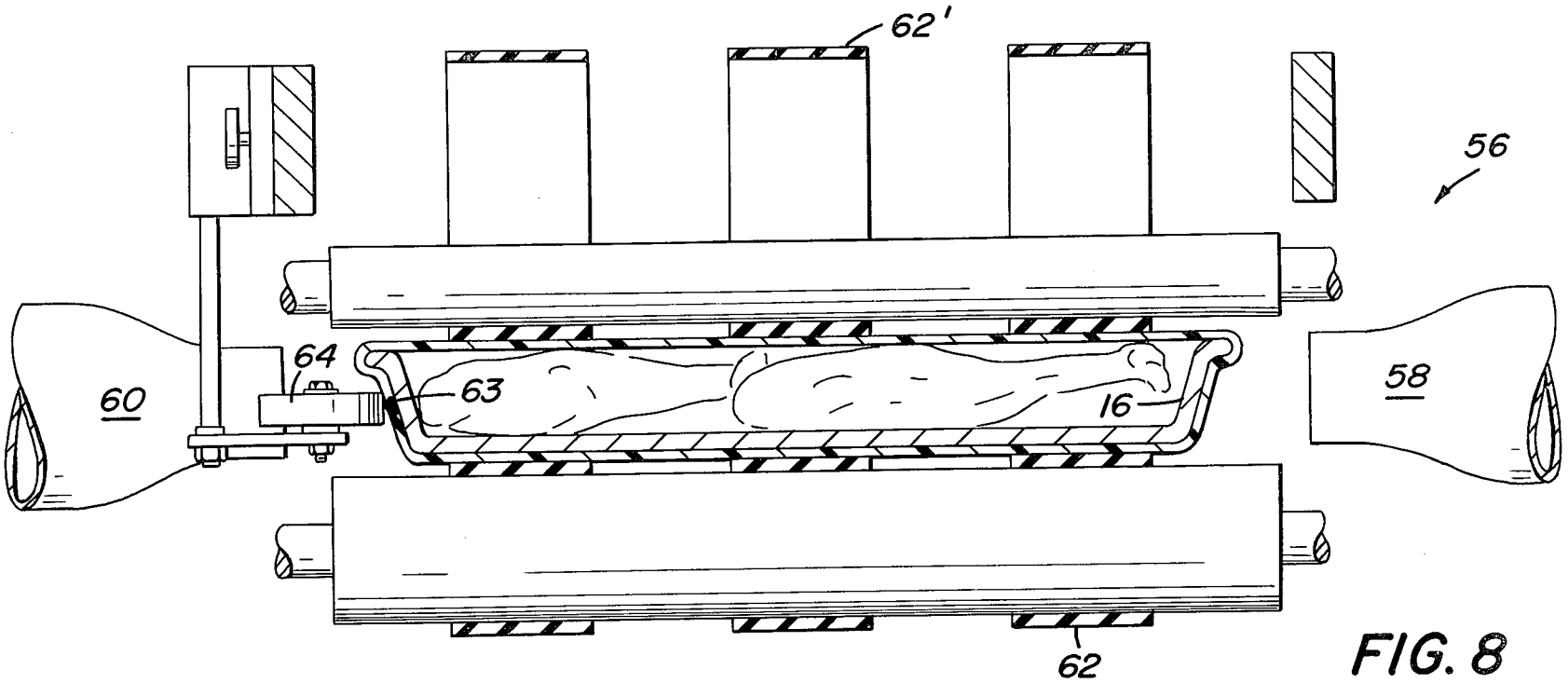
FIG. 8 is a sectional view taken along the line 8—8 in FIG. 5.
Figure 9:
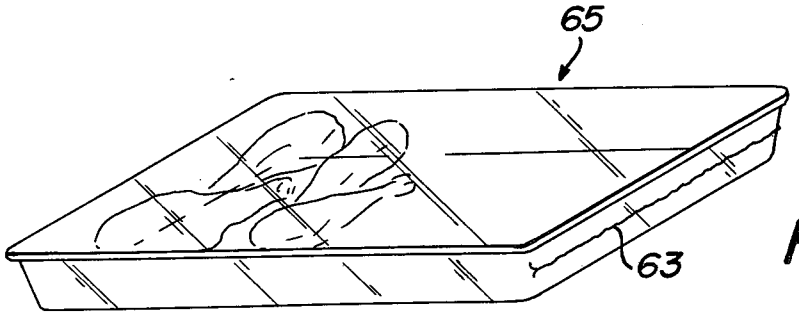
FIG. 9 is a perspective view of a bagged tray produced by the apparatus of the present invention.

Thereafter, the bagged tray continues onto the shrink station 56. At the shrink station 56, the bagged tray is supported by a plurality of conveyor belts 62 and is disposed between a pair of nozzles 58, 60 which extend toward each other. See FIG. 8. The nozzles 58, 60 blow hot air at the opposite sides of the bag 32 to shrink the bag around the tray 16. A smoothing wheel 64 is positioned downstream from the nozzle 60 for contact with the weld bead 63 to smooth out the area of the weld bead in conformity with the shape of the tray 16. The end product is a bagged tray 65. See FIG. 9. The bag 32 is preferably a transparent polymeric plastic material such as polyethylene whereby the contents of the tray 16 will be visible. The particular material for the plastic bag and its transparency are a matter of choice.

Figure 3:
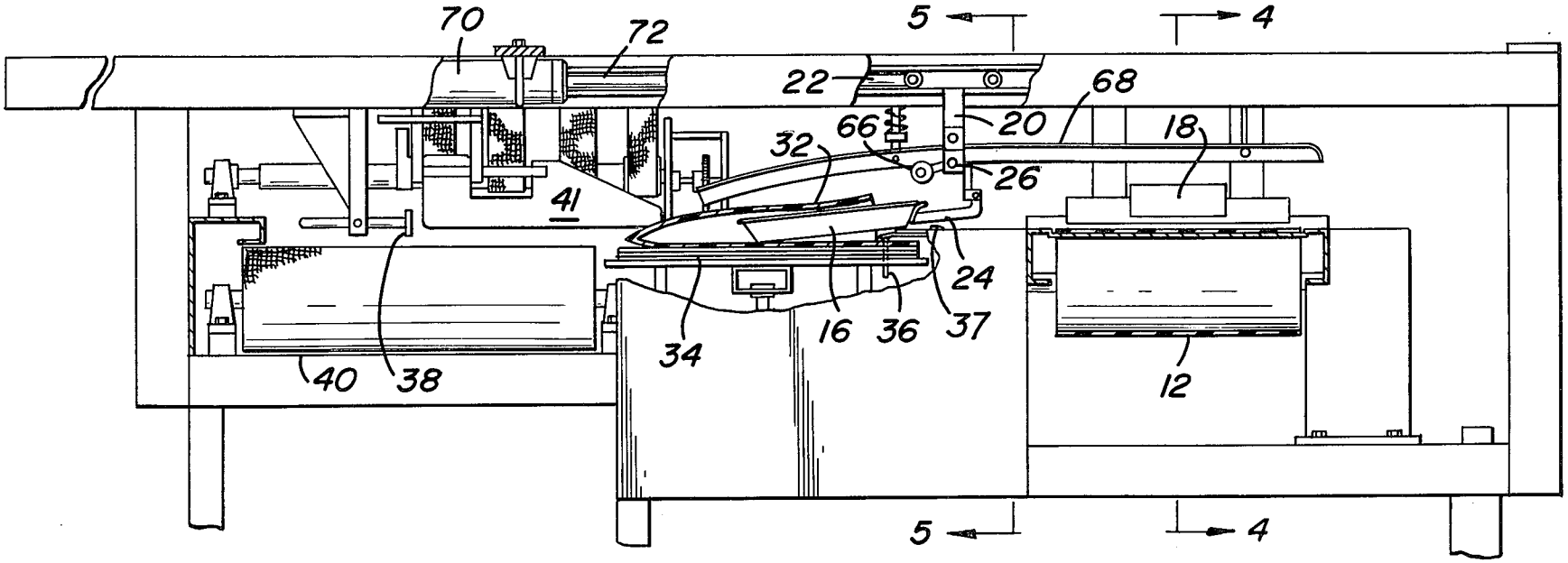
FIG. 3 is a sectional view taken along the line 3—3 in FIG. 1 but on an enlarged scale.

Referring to FIG. 3, the pusher 24 pushes the tray 16 between the pivotably mounted gates 28, 30. In order that the pusher 24 does not crash into the gates 28, 30 on the return stroke, the pusher 24 may pivot about pin 26. On the return stroke of the carriage 20, a cam follower 66 on the pusher 24 rides up to the cam track 68 thereby pivoting the pusher 24 upwardly for its return stroke. The carriage 20 is moved along the track 22 by cylinder 70 having a piston rod 72 connected at one end to the carriage 20. A source of pressurized air is selectively coupled to opposite ends of the cylinder 70 to effect reciprocation of the carriage 20.

Figure 5:
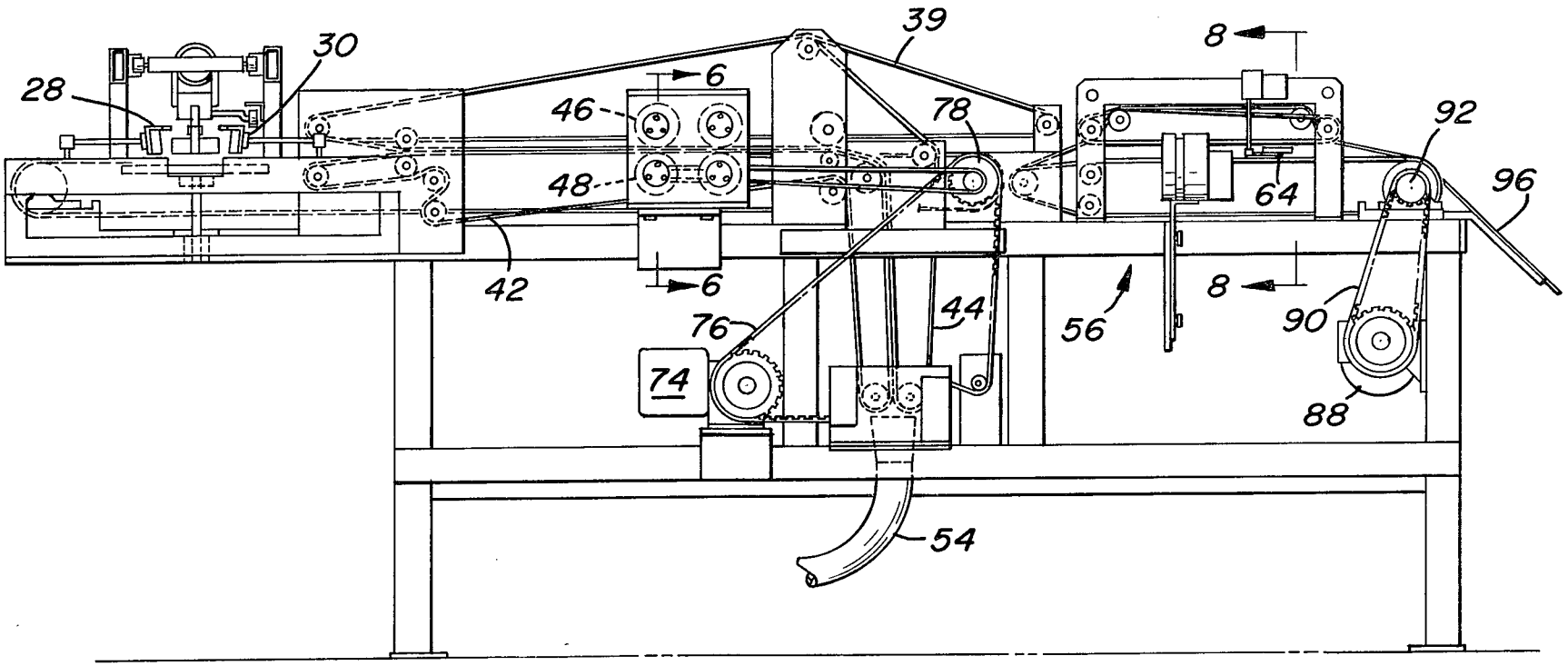
FIG. 5 is a sectional view taken along the line 5—5 in FIG. 3.

As shown more clearly in FIGS. 2 and 5, the frame of the apparatus 10 includes a drive motor 74 coupled to a timing belt 76. The timing belt 76 is coupled to the drive roller 78 of the conveyor 40. An endless belt 80 extends from the drive roller 78 to the trim cutting wheel 50 and the welding rollers, 46, 48 so that the latter rotate with a surface speed matching the speed of the bag 32 as it moves along conveyor 40. The timing belt 76 also drives rollers 82, 84 which in turn drive the belts 42, 44 in timed relationship with the moving bag 32. Belt 44 extends around roller 86 which in turn drives the belts 39 in timed relationship. Accordingly, all of the wheels and belts associated with conveyor 40 are driven in synchronization therewith from the single drive motor 74.

At the shrink station 56, the frame supports a second drive motor 88. The motor 88 is connected to the drive roller 92 by a timing belt 90. The drive roller 92 drives the belt 62. A belt 94 is coupled to the drive blower 92 and innerconnects the same with rollers associated with the upper set of drive belts 62' at the shrink station 56.

The apparatus 10 preferably operates in the following manner. Trays 16 are manually or mechanically loaded with goods or products of any desired nature and then are positioned on the infeed conveyor 12. Conveyor 12 moves the loaded trays 16 beneath the height gauge 14. If the contents of the trays 16 are piled too high, the height gauge 14 will be tripped and conveyor 12 will thereafter be stopped. It is not necessary to position the trays 16 with any predetermined spacing between them on the conveyor 12.

As soon as a loaded tray contacts the switch plate 18, a circuit is completed to a valve which supplies air to cylinder 70. Cylinder 70 will cause the carriage 20 to recipricate from right to left in FIG. 3 thereby causing the pusher 24 to move the tray 16 toward the opened bag 32. Carriage 20 will trip a microswitch which will pivot the gates 28, 30 so that their free end enters the opened bag 32 and holds the same in a position so that the tray 16 may pass therebetween and into the bag 32. Gates 28, 30 prevent bag 32 from collapsing due to the fact that tray 16 now blocks air from flowing into the bag from nozzle 37. The continued forward motion of the pusher 24 strips the bag 32 from the pins 36 and deposits the bag and tray against the limit stop 38 on conveyor 40.

If due to the spacing between the trays 16 on conveyor 12, the next tray contacts switchplate 18, nothing will happen until the pusher 24 has returned to its start position. As soon as the bag 32 and tray 16 are deposited on the conveyor 40, they will be squared by the squaring plate 41. The carriage 20 will have tripped a micro switch to move gates 28, 30 to their inoperative position and to cause carriage 20 to return to its start position. During the return stroke of the carriage 20, the follower 66 will ride up to cam track 68 thereby raising the pusher 24 above the elevation of the gates 28, 30 and any tray 16 adjacent the switchplate 18. If there is a new tray 16 contacting the switchplate 18, the pusher 24 will immediately reciprocate such tray toward the next bag 32 to repeat the cycle as described above. Otherwise, the pusher 24 will await the arrival of a new tray 16.

As the bag 32 with the tray 16 therewithin moves along the conveyor 40, the belts 39 engage the bag 32 and flatten it out against the open top of the tray 16. Belts 42, 44 embrace the open end of the bag and hold the same so that an intermediate portion may be welded adjacent a side edge of the tray 16 by the rollers 46, 48. Thereafter, the trim scrap will be cut by the cutter wheel 50. The trim scrap is transferred by belts 42, 44 to the vacuum nozzle 54 while the bagged tray 65 continues to the shrinking station 56.

At the shrinking station 56, the bag is subjected to hot air at a temperature of approximately 175° C from the nozzles 58, 60. The bag shrinks around the tray 16 and the weld bead 63 is flattened against the tray by the wheel 64. Thereafter, the bagged tray 65 is deposited onto any conveyor or plate 96 from which it enters a container (not shown) for completion of packaging and shipping. The apparatus 10 is capable of high rates of production irrespective of the rate of feed of trays 16 on conveyor 12 thereto while being completely automatic.

The present invention may be embodied in other specific forms without departing from the spirit or essential attributes thereof and, accordingly, reference should be made to the appended claims, rather than to the foregoing specification as indicating the scope of the invention.

I claim:

1. Apparatus for automatically bagging open top trays comprising a first conveyor for delivering open top trays to pushing means arranged to automatically push an open top tray off said conveyor and into a separate open bag at a bagging station, a second conveyor for receiving each bagged tray, said second conveyor including means for applying pressure to the top surface of the tray as the tray is moved along said second conveyor, means along side said second conveyor for sealing a bagged tray by welding the open end of the bag adjacent a side edge of the tray and for trimming scrap off the bag adjacent the weld as each bagged tray moves along said second conveyor, said pushing means including a carriage and a pusher support for reciprocation toward and away from the bagging station, means for removing scrap away from the second conveyor, and means downstream from said welding means for contacting and smoothing the weld bead in conformity to the shape of the tray.

2. Apparatus in accordance with claim 1 including switch means fo sensing the presence of a tray in a position to be pushed from the first conveyor by the pusher to the bagging station, said last mentioned means being coupled to circuitry for operating the pusher so that the pusher moves in response to the presence of a tray adjacent the pusher.

3. Apparatus in accordance with claim 2 wherein said switch means is a switch plate above said first conveyor so as to be in the path of trays on said first conveyor.

4. Apparatus for automatically packaging open top trays comprising:

(a) a first conveyor for moving an open top tray to a pusher, (b) a pusher, means connected to the pusher for reciprocating the pusher along a predetermined path, (c) means for supporting a stack of bags, nozzle means for directing air toward the uppermost bag of the stack for opening the uppermost bag in a position for receiving a tray, (d) means for detecting the presence of a tray at said pusher and for causing the pusher to push the tray off said first conveyor into the open uppermost bag and for pushing the tray and bag to a limit stop associated with the second conveyor, (e) a second conveyor, (f) means alongside said second conveyor for embracing and holding the open end of the bag closed as the bag and tray move along said second conveyor, (g) means for welding the open end of the bag adjacent to an edge of the tray as the bag and tray move along said second conveyor, (h) means for cutting off scrap adjacent the weld as the bag and tray move along the second conveyor, (i) means for removing said scrap, (j) means for applying heat to shrink the sealed plastic bag around the tray as the bag and tray are moved to a discharge receiver, and (k) means for elevating said pusher during its return stroke towards said first conveyor.

5. Apparatus in accordance with claim 4 wherein said first and second conveyors are parallel to one another and said predetermined path of said pusher being perpendicular to said conveyors in a manner so that the pusher may transfer a tray from the downstream end of the first conveyor to the upstream end of the second conveyor.

6. Apparatus in accordance with claim 4 wherein said means for removing scrap and said means for holding the open end of the bag closed are a pair of endless cooperating belts driven in synchronism with said second conveyor.

7. Apparatus in accordance with claim 4 wherein said predetermined path of the pusher is perpendicular to the path of the first conveyor, and said first conveyor having a height gauge thereabove for stopping the first conveyor in the event that the height of a tray and its contents is above a predetermined maximum.

8. Apparatus in accordance with claim 4 wherein said tray detecting means is a switchplate positioned above the first conveyor adjacent the downstream end thereof and at an elevation so that it will be contacted by a tray moving on the first conveyor, said switchplate being downstream from the pusher so as to stop a tray in front of the pusher.

9. Apparatus in accordance with claim 4 including a pair of pivotably mounted gates adjacent the means for supporting a stack of bags, said gates being mounted for movement so that a free end thereof may pivot into and hold open a bag while the pusher passes between the gates and pushes a tray into the uppermost bag of the stack.

10. Apparatus in accordance with claim 4 including means downstream from said heat shrinking means for contacting and smoothing the weld bead in conformity to the shape of the tray while the tray is moving.

11. Apparatus in accordance with claim 10 wherein said smoothing means is a wheel supported for rolling contact with the tray as the tray moves past the wheel.

* * * * *